United States Patent [19]

McHenney

[11] 4,345,806

[45] Aug. 24, 1982

[54] WIRE HARNESS RETAINER CLIP

[75] Inventor: John R. McHenney, Fort Wayne, Ind.

[73] Assignee: International Harvester Co., Chicago, Ill.

[21] Appl. No.: 178,316

[22] Filed: Aug. 15, 1980

[51] Int. Cl.[3] ..... H01R 31/08

[52] U.S. Cl. ..... 339/19; 339/75 M; 339/198 K; 339/222

[58] Field of Search ..... 339/19, 222, 198 R, 339/198 K, 75 R, 75 M; 174/138 G, 138 R, 149 B; 411/511, 512, 520, 546

[56] References Cited

U.S. PATENT DOCUMENTS

| | | | |
|---|---|---|---|
| 1,639,310 | 8/1927 | Richardson | 339/198 R |
| 3,340,760 | 9/1967 | Wormser | 411/520 |
| 3,426,319 | 2/1969 | Downs et al. | 339/198 R |
| 3,728,656 | 4/1973 | Neuber | 339/19 |
| 3,831,129 | 8/1974 | Frey | 339/19 |
| 3,962,719 | 6/1976 | Pfaff | 174/138 G |

FOREIGN PATENT DOCUMENTS

| | | | |
|---|---|---|---|
| 2257888 | 5/1974 | Fed. Rep. of Germany | 174/138 G |

*Primary Examiner*—John McQuade

*Attorney, Agent, or Firm*—F. J. Krubel; F. D. Aubuchon

[57] ABSTRACT

A retainer clip for securing a first electrical wire terminal lug to an electrical terminal contact post of a junction block. The retainer clip may have one or more snap tabs, each of which is snapped around a respective post. Finger tip or tool gripping holes may be provided in the body in the case of a ganged plurality of snap tabs, or side cutouts may be provided in the case of one snap tab which facilitate easy removal of the snap tab from the respective terminal contact post after a second terminal lug is mounted on the post on top of the snap tab retained first terminal lug and a securing nut is threaded onto the post for mechanically connecting the first and second electrical wire terminal lugs to the same post.

10 Claims, 6 Drawing Figures

WIRE HARNESS RETAINER CLIP

This invention relates to electrical systems in motor vehicles. In general, the invention concerns an electrical wiring harness and a junction block. In particular, the invention relates to a novel retainer clip for securing one or more terminal lugs to one or more terminal contact posts on the junction block during assembly of the electrical wiring harness.

In automotive electrical systems, particularly in large highway motor trucks, junction blocks are usually used as connecting panels to join one or more wiring harnesses together in the course of wiring up various circuits of the automotive electrical systems. During the assembly of the wiring harness, the wires at one end are provided with terminal lugs. The junction block usually has one or more threaded terminal contact posts, insulted from one another, for the reception of the terminal lugs of the wiring harness. The terminal lugs are slipped over appropriate terminal contact posts and some securing means, such as finished hexagon jam nuts or spring steel flat nuts, are used to retain the lugs on the posts preparatory to shipping the wire harness and junction block combination to another location for installation into the automotive vehicle and hook up with other wire harnesses.

A problem with the wire harness, junction block and jam nut combination is in maintaining a tight electrical connection during the hook up operation with other wire harnesses. In shipping and in handling the wire harness combination, while it is being installed in the vehicle, the wires are subjected to bending, flexing and twisting. This movement of the wires may loosen one or more of the hexagon jam nuts, resulting in a backing up of the loosened jam nut on the threaded terminal contact posts. When a mating or second terminal lug of a mating or second wire harness is placed on top of the loosened jam nut, and a second nut, such as a self-locking nut, is threaded on this terminal post over the second terminal lug, a double nut effect results. The original or first terminal lug, which is below the loosened jam nut cannot be tightened for a good electrical contact to the base plate of its terminal post.

A problem with the wire harness, junction block and spring steel flat nut combination is also in maintaining a tight electrical connection during hook up operation with other wire harnesses. Due to the dished surface of the spring steel fastener, the fastener does not flatten sufficiently to compress the first terminal lug against the contact base plate of its terminal contact post. Attempting to flatten the spring fastener by tightening the lock nut above the second terminal lug may result in shearing this terminal contact post. The spring steel fastener also creates a double nut effect so that it must be removed before the second terminal lug of the mating second wire harness is placed over the terminal contact post. Since the spring steel fastener is thin, it does have sharp corners and edges. Care and caution must be exercised when removing the spring steel flat nut from the terminal contact post, to prevent gouging or cutting of the insulation around the wire.

The wire harness retainer clip means of my invention corrects the aforementioned problems with jam and spring steel flat nuts used in connecting one or more terminal lugs of a first wire harness to one or more terminal contacts posts on a junction block. It temporarily secures one or more terminal lugs of the wiring harness to one or more threaded terminal contacts posts of a junction block during the shipment and during the installation of such wire harness in a final location. My novel wire harness retainer clip means is made from a generally rectangularly shaped thin flexible flat strip of a plastic, non-conductive material, such as mylar. The retainer clip means has at least one terminal contact post snap-on tab means which is formed by a substantially triangularly or V-shaped groove partially defined by edge portions conveying laterally inwardly from one side edge side of the flat strip. The terminal contact post snap-on tab means further includes a terminal contact post confining hole, which conforms in shape and size to a cross-section of the terminal contact post. The hole intersects with the bottom of the V-shaped groove at a point where the distance or span between the converging edges of the groove at the bottom thereof is of a dimension less than the cross-section of the terminal contact post, thereby forming a restricted passageway and a pinchers-like means for confining the terminal contact post in the hole in a non-flex state of the tab means. As the terminal contact post enters the tapering groove and begins to contact the tab means along the narrowing groove walls leading toward the restricted passageway or pinchers-like means, the tab means begins to flex on opposite sides of the V-shaped groove and open the restricted passageway or pinchers-like means for the passage of the terminal contact post into the confines of the hole. In order to provide stiffness for snapping the plastic tab means onto the terminal contact post, the tab means is laterally crimped on the wide side of the opposite sides of the tapering groove. More than one crimped tab means may be provided on the strip of plastic tab material for attachment to more than one terminal contact post on a junction block. In which case, the tab means are isolated from one another by a plurality of uniformly spaced and parallel laterally extending straight grooves. The straight grooves are of a width and length to clear a plurality of terminal contact post isolation blocks, which are usually on the junction block. To facilitate removal of the bank of tab means from the bank of terminal contact posts at the installation of the second wiring harness, preparatory to applying torque to the lock nuts on the terminal contact posts, large tool or finger tip grip holes are provided in the flat sides next to the opposite thin side of the strip, and which intersect with the straight grooves. The plastic material remaining between adjacent grip holes forms a flexible shank or throat for each tab means. A semi-circular cutout forms the end shank or throat for an individual tab and the shank or throats for the tabs at the opposite ends of the strip of tab means. The wire harness retainer clip securely retains the terminal lugs on the terminal contact posts during shipment and during installation of the wiring harness in the vehicle. It is removed by gripping the side cutouts in the case of an individual snap tab or by gripping the grip holes with a tool or finger tips and firmly pulling the individual tab or the bank of tab means from the terminal contact post. There is no danger to the wire insulation in removing the retainer clip from the terminal contact post prior to tightening of the final lock-nuts on the row of contact posts and compressing the original and mating terminal lugs against one another and to the base of the contact post. Thus my novel wire harness retainer clip eliminates the double nut effect and ensures the best possible electrical connection between mating wire harnesses on the junction block. As an alternative, the wire harness retainer clip can be provided with electrical conductive surface or surfaces, to provide electrical conductivity and preclude the need to remove the bank of tab means from the terminal contact posts during final assembly. Also, conductive surfaces could be provided to permit electrical conductivity between two or more terminal contact posts on the junction block. This conductive surface could also provide a fuse effect for short circuit protection. In addition, the retainer clip has application components other than junction blocks, and terminals other than threaded contact post terminals, and has provisions for different configurations of junction blocks; and for use of other materials to facilitate manufacture, assembly, and/or performance characteristics. The specific features of my wire harness retainer clip are:

1. The wire harness retainer clip has one or more snap tabs means for attaching it to one or more terminal contact post on a junction block. This attachment secures the retainer clip and any wiring component that is placed on the terminal post junction block prior to its attachment.
2. The wire harness retainer has any number of snap-tab terminal post attachment means connected together as one piece to mate with a junction block having a lesser, even or higher number of terminals.
3. The wire harness retainer clip has a means of removal from the junction block after all related components are assembled. This enables the secondary harness to be captivated before the retainer is removed.
4. The wire harness retainer clip has provisions for gripping the retainer either by hand or by a tool to facilitate its removal.
5. The harness retainer clip may be color coated to identify present, function, or harness polarity.
6. The harness retainer clip may include conductive surfaces to provide electrical conductivity between two or more wiring terminals.
7. The wire harness retainer clip has capability to be reused. This can include recycling on new harnesses of the same or similar design, or in securing primary and secondary harnesses until a third, a fourth or higher order harness is attached to the junction block.

In order that the invention may be readily understood and put into practical effect, reference will now be made to various figures of the drawing in which.

Figure 1:
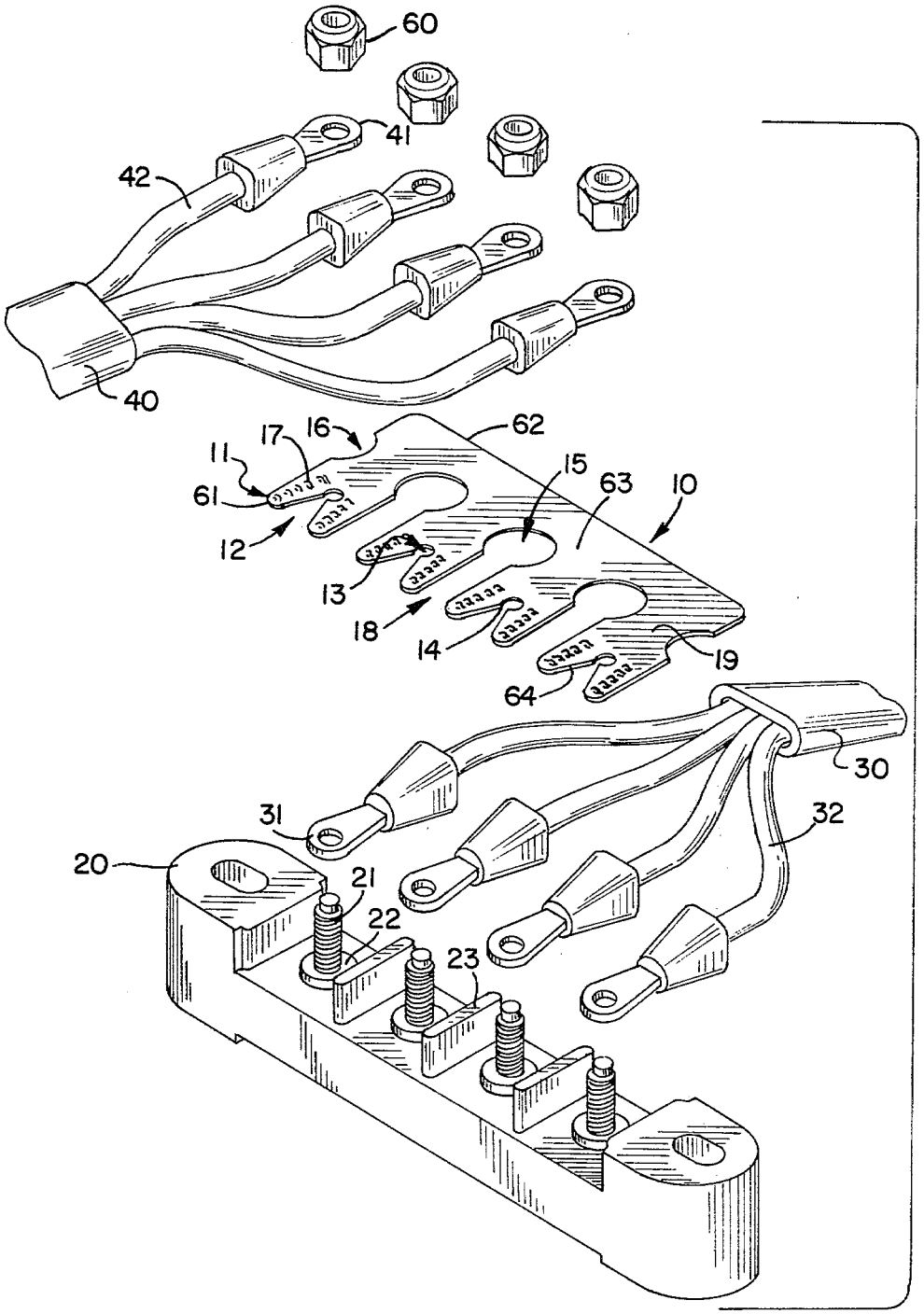
FIG. 1 is an exploded isometric view of a typical primary and secondary wiring harness hookup on a junction block with a wire harness retainer clip means according to the invention.
Figure 2:
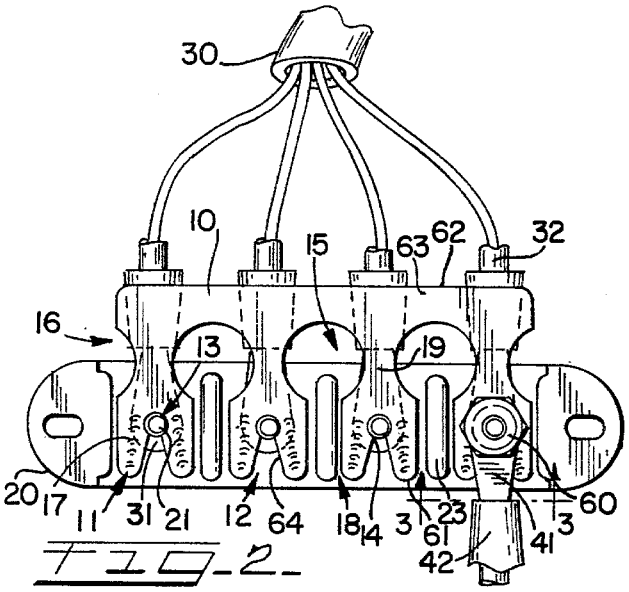
FIG. 2 is a top view of the FIG. 1 harness retainer clip means securing a number of first terminal lugs of the primary wiring harness to a bank of terminal contact posts on the junction block, and a lock nut securing a second terminal lug of the secondary wiring harness to one terminal contact post.

With reference to FIG. 1, there is shown a junction block 20 which is a device used to connect two or more wiring cables together. It may have any number of threaded terminal contact posts or other devices 21, to hold the terminal lugs 31, 41 of the wiring cables 32 and 42, respectively. The primary electrical wiring harness 30 is the first wiring component that is attached to the junction block 20 during harness assembly. Typically, the wires 32 are terminated with eyelet or similar type terminal lugs 31. The wire harness retainer clip 10, of my invention, has one or more snap-tab means 11 which secure the lugs 31 to the contact posts 21 on the junction block 20. It insures the integrity of the assembly until the final installation is completed.

The secondary wiring harness 40 is the second wiring component and is added to the junction block 20 during the final installation. Typically the wires 42 are also terminated with eyelet or similar type terminal lugs 41. Lock nuts 60, which are permanent fastener devices, secure the primary and secondary harnesses 30 and 40 to the junction block 20 during final assembly after the retainer clip 10 is removed from the contact posts 21.

The retainer clip means 10 shown in FIGS. 1 through 4 inclusive, is made from a relatively flat strip of an electrical non-conductive flexible material, such as mylar, and has a generally rectangular configuration. The flat strip is provided with a plurality of longitudinally spaced terminal post snap-on tab means 11. Each terminal post snap-on tab means is partially formed by a generally triangularly or V-shaped groove 12 partially defined by side edges which coverage laterally inwardly from one side edge 61 of the flat strip and intersect with a hole 13, which is preferably circular in shape, provided through a side portion 63 of the strip. The circular hole 13 generally conforms in shape and size to a cross-section of a conventional terminal contact post 21. The intersection of the V-shaped groove 12 and hole 13 form a restricted passageway means 14 of a width smaller than the diameter of the hole 13 in a non-flex state of the tab means 11 along the V-shaped groove 12 for confining the terminal contact post 21 in the hole 13. As clearly shown in FIG. 5, the edges of the strip defining each V-shaped groove and the hole 13 associated therewith partially define a pair of elongated, laterally extending terminal post snap-on tabs. The terminal contact post 21 engages the tab means 11 along the converging edges 64 of the V-shaped groove 12 leading toward the restricted passageway means 14, thereby flexing the tab means 11 on opposite sides of the V-shaped groove 12 and opening the restricted passageway means 14 for passage of the terminal contact post 21 into the confines of the hole 13. Each elongated, laterally extending snap-on tab of each tab means 11 is provided with a series of suitable crimp means 17 along its length for imparting stiffness or inflexibility thereto.

Figure 4:
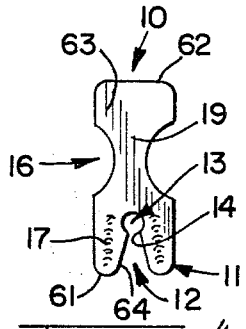
FIG. 4 is a top view of a single snap tab means of a wire harness clip means, in accordance with my invention.
Figure 5:
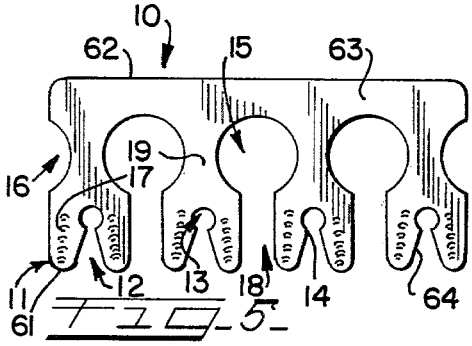
FIG. 5 is a top view of the FIGS. 1 and 2 wire harness clip means.

As shown in FIG. 5, the flat strip is provided with a plurality of uniformly spaced apart tab means 11. Each one of the plurality of tab means 11 is separated from the tab means 11 adjacent thereto by a straight groove 18. The grooves 18 are uniformly spaced and generally parallel and extend laterally from the side edge 61 of the strip and each groove 18 intersects with a respective one of a plurality of second holes 15, which are uniformly spaced from each other and intermediate the side edges 61, 62 of the strip. As a result, each of the tab means 11 is integrally formed with and, in effect, depends from the marginal portion 63 of the strip contiguous to the side edge 62 through the intermediary of a relatively narrow and flexible shank or throat 19. The second grooves 18 are of a width providing sufficient clearance over generally rectangular block shaped blocks 23 isolating adjacent contact terminal posts 21 on the junction block 20, and the second holes 15 are preferably circular in shape and have a considerably larger diameter than the holes 13 so as to facilitate gripping the marginal edge portion 63 with a suitable tool or the tips of one's fingers in order to remove the retainer clip from engagement with the junction block. The shank or throat 19 utilized to interconnect each tab means 11 to the marginal edge portion 63 is, in effect, provided by the material remaining between adjacent tool or finger tip gripping holes 15. Thus, because of the relatively large size of each of the aligned holes 15, the shanks or throats 19 have relatively narrow widths, and, consequently each tab means 11 may readily flex with respect to the other tab means 11 to facilitate placement of the retainer clip on the terminal contact posts 21 of the junction block during use. Semi-circular cutouts 16 form the throats 19 of the end most tab means 11 of the plurality or gang of snap tab means 11 shown in FIGS. 1, 2 and 5. As shown in FIG. 4, semi-circular cutouts 16 also form the throat 19 and the means for removing a single snap tab means 11.

After the terminal lugs 31 of the primary electrical harness 30 are secured to the terminal contact posts 21 of the junction 20, by the snap tab means 11 of the wire retainer harness clip means 10, the unit is then shipped to another location for final installation. At the final installation, the terminal lugs 41 of the secondary electrical harness 40 are then slipped over the terminal posts 21 on top of the retainer clip means 10 and the lock nuts 60 are threaded over the contact posts 21 on top of the secondary terminal lugs 41. The retainer clip means 10 is then pulled from the terminal posts and the lock nuts are tightened, compressing the secondary terminal lugs 41 against the primary terminal lugs 31 and the primary terminal lugs 31 against the bases 22 of the terminal contact posts 21 thereby insuring a firm electrical and mechanical connection.

Figure 6:
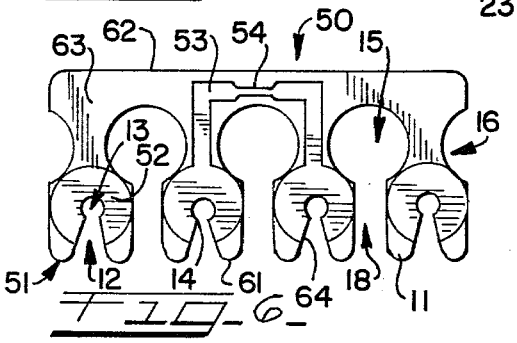
FIG. 6 is a top view of an alternative embodiment of a wire harness clip means with electrical conductive coating around the terminal post confining holes, and with a fused circuit strip between two snap tab means.
Figure 3:
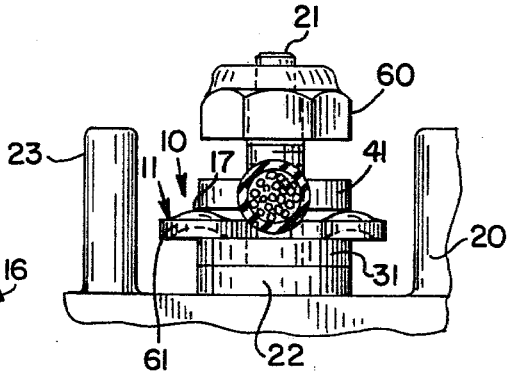
FIG. 3 is a view taken on lines 3—3 of FIG. 2.

In the alternative embodiment shown in FIG. 6 the inner and outermost tab means 51 are each coated with an electrical conductive material 52 around the contact terminal post confining holes 13. A band of electrical conductive material 53 is shown connecting the electrical conductive coating 52 of two innermost tab means 51. The band 53 is also shown having a reduced fusable section 54 between the two electrically connected innermost snap tab means 51.

What is claimed is:

1. A retainer clip means for securing electrical wire terminal lugs to a plurality of spaced and aligned electrical terminal contact posts of a junction block having a raised block isolating each contact post from the contact post adjacent thereto, the retainer clip means made from a substantially flat and relatively thin strip of an electrical non-conductive flexible material having a generally rectangular configuration, and having at least one terminal post snap-on tab means, said terminal post snap-on tab means being formed by a substantially V-shaped groove having side edges converging laterally, inwardly from a first side edge toward a second, substantially straight side edge of the flat strip, said terminal post snap-on tab means being further formed with a generally circular hole through a portion of the strip intermediate said first and second side edges, said hole intersecting said V-shaped groove at the bottom thereof and generally conforming in shape and cross-sectional area to the outer contour and cross-sectional area of a terminal contact post, the edges of the strip defining said V-shaped groove and said hole partially defining a pair of elongated, laterally extending terminal post snap-on tabs and the intersection of the V-shaped groove and the hole forming a restricted passageway means of a width smaller than the diameter of said hole in a non-flexed state of the tab means along the V-shaped groove for confining a terminal contact post in the hole, the terminal contact post being engageable with the tab means along said converging side edges of the V-shaped groove leading toward the restricted passageway means thereby flexing the strip portions on opposite sides of the V-shaped groove defining said restricted passageway means and thereby permitting passage of a terminal contact post into the confines of the hole; and flexible shank means operatively interconnecting said terminal post snap-on tab means to a marginal portion of said strip contiguous to said second, substantially straight side edge laterally spaced from said first side edge.

2. A retainer clip means according to claim 1, including means for imparting stiffness to said tabs of said tab means including crimp means disposed along the length of each of said tabs.

3. A retainer clip means according to claim 1, including a plurality of tab means uniformly spaced along the longitudinal axis of said strip, the flexible shank means of each of said tab means being spaced from the flexible shank means of the tab means adjacent thereto by a respective one of a plurality of longitudinally spaced openings formed through said strip.

4. A retainer clip means according to claim 1, including a plurality of tab means uniformly spaced along the longitudinal axis of said strip, each of said tab means being separated from the tab means adjacent thereto by a respective one of a plurality of longitudinally spaced and substantially parallel and straight grooves extending laterally from said first side edge toward said second side edge.

5. A retainer clip means according to claim 4, including means for facilitating gripping of the retainer clip means for application of said tab means of said retainer clip means to and removable thereof from the terminal contact posts of the junction block.

6. A retainer clip means according to claim 5, wherein said means for facilitating application of said tab means of said retainer clip means to and removable thereof from the terminal contact posts of the junction block includes a plurality of longitudinally spaced openings formed through said strip, each of said openings being intersected by a respective one of said straight grooves, each of said opening and the straight groove associated therewith accommodating insertion of a respective one of the raised blocks of the junction block therein when the retainer clip tab means are applied to the terminal contact posts of the junction block and said openings are of a size to permit insertion of finger tips or a tool to grip the retainer clip means along one longitudinal side edge thereof.

7. A retainer clip means according to claim 3, wherein at least the strip surface portion generally outlining the contact terminal post confining hole of a one of said tab means is coated with electrical conductive material.

8. A retainer clip means according to claim 7, wherein the strip surface portion generally outlining the contact terminal post confining hole of a second tab means is coated with electrical conductive material, and wherein a band of electrical conductive material electrically connects the electrical conductive coatings of the two tab means.

9. A retainer clip means according to claim 8, wherein the band of electrical conductive material has a reduced width fusible section between the two tab means.

10. A retainer clip means according to claims 2 or 3, wherein the flat strip of electrical non-conductive flexible material is made of a plastic material.

* * * * *